US005414202A

United States Patent [19]

Berger et al.

[11] Patent Number: 5,414,202

[45] Date of Patent: May 9, 1995

[54] METHOD FOR RAPID DECOMPOSITION OF METHYL CHLOROMETHYL AND BIS(CHLOROMETHYL) ETHERS

[75] Inventors: Scott A. Berger, Horsham; Richard B. Wuchter, Huntington Valley, both of Pa.; Pietro A. Stefanelli, Albano S.A., Italy

[73] Assignee: Rohm and Haas Company, Philadelphia, Pa.

[21] Appl. No.: 245,393

[22] Filed: May 18, 1994

[51] Int. Cl.[6] ..... A62D 3/00

[52] U.S. Cl. ..... 588/206; 134/6; 134/10; 134/47; 423/240 R; 423/245.2; 585/733; 208/262.5; 588/207; 588/215; 588/901

[58] Field of Search ..... 588/205, 206, 215, 218, 588/207, 901; 585/733; 208/262.1, 262.5; 134/40, 47, 6, 7; 423/240 R, 245.2

[56] References Cited

U.S. PATENT DOCUMENTS

| | | | |
|---|---|---|---|
| 3,162,952 | 10/1973 | Gouiw et al. | 134/22.14 |
| 3,980,755 | 9/1976 | Black et al. | 423/210 |
| 4,130,629 | 12/1978 | Velewovsky | 423/245.2 |
| 4,225,677 | 9/1980 | Boutier et al. | 521/31 |
| 4,844,745 | 7/1989 | Nash et al. | 208/262.5 |
| 5,001,293 | 3/1991 | Wubel et al. | 585/733 |
| 5,110,364 | 5/1992 | Mazur et al. | 208/262.5 |
| 5,336,329 | 8/1994 | Langewmayr | 134/6 |

*Primary Examiner*—Gary P. Straub
*Attorney, Agent, or Firm*—John E. Taylor, III

[57] ABSTRACT

Surfaces contaminated with chloromethylmethyl ether and bis-chloromethyl ether may be decontaminated by treating them with an aqueous solution of a basic organic amine, for example a tertiary amine, a nonionic surfactant and an alkali-metal hydroxide.

15 Claims, No Drawings

METHOD FOR RAPID DECOMPOSITION OF METHYL CHLOROMETHYL AND BIS(CHLOROMETHYL) ETHERS

This application relates to decontamination of hazardous spills by decomposition of the chemical compounds involved, and particularly to decomposition of methyl chloromethyl ether and bis(chloromethyl) ether by treating them with a polyamine in the presence of a surfactant and a base.

BACKGROUND OF THE INVENTION

Methyl chloromethyl ether (CME) is a chemical intermediate which is widely used to introduce a reactive chloromethyl group into a molecule, to permit further substitution of that molecule. Both CME and an impurity found in it, bis-chloromethyl ether (BCME), are toxic and volatile. These properties have led industries which employ them to design equipment and processes which minimize the exposure of workers and the environment to them. One important consideration in minimizing such exposure is the effective cleanup of spills. Normal response to the spill involves, inter alia, removing the free liquid to an appropriate reservoir, but this leaves surfaces which have contacted the CME contaminated with a small but significant amount of the CME. Porous surfaces, such as concrete, wallboard, insulation, wood, wood products and the like, are especially troublesome because the CME penetrates into the pores, where it is difficult to wash away with a stream of water. The volatile ethers continue to evaporate from the contaminated surfaces, even at low concentrations, and thus will contaminate the air in the vicinity of the spill until they are eliminated. A rapid, effective method is needed for decontaminating surfaces contaminated with the toxic CME and BCME from such spills.

SUMMARY OF THE INVENTION

We have discovered a process by which surfaces contaminated with CME, BCME or mixtures thereof, may quickly be decontaminated, and by which the CME, BCME or mixtures thereof may be converted into relatively innocuous materials, which process comprises contacting the surface contaminated with CME, BCME or mixtures thereof with an alkaline aqueous solution containing one or more basic organic amines, one or more alkali-metal hydroxides and one or more nonionic surfactants.

DETAILED DESCRIPTION OF THE INVENTION

Although Applicants do not wish to be bound by the following theory, the organic amine is thought to react with CME and BCME according to the following reactions:

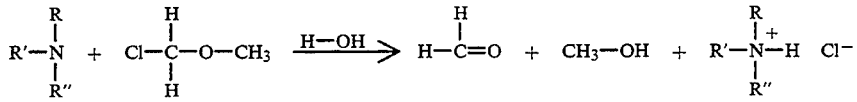

and

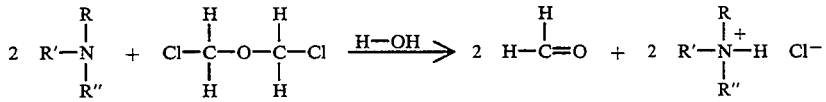

In each reaction, if a base is present, it will react with the amine hydrochloride to regenerate the original amine, which is then available to react with more CME or BCME.

However, in view of the observed effectiveness of the aqueous decontaminating solution of the present invention, these reactions appear to oversimplify the actual mechanism by which the decontaminating solution destroys the ethers. Thus, while aqueous solutions of amines or amines with alkali-metal hydroxides decontaminate CME and BCME spills, decontamination efficacy is significantly improved by incorporating the surfactant into the decontaminating solution. This is particularly true when the liquid containing the CME and BCME forms a film on a surface, or penetrates the pores of a porous material.

Any basic organic amine is operative in the present invention, however the preferred organic amines are those which are relatively non-volatile, non-toxic, low in odor and strongly basic, such as alkyl polyamines, including methylene, ethylene and propylene polyamines. Particularly preferred are strongly nucleophilic amines such as tertiary alkyl or hydroxyalkyl polyamines in which the alkyl or hydroxyalkyl groups are C1–$C_6$ alkyl, for example, N-alkyl-substituted and N-hydroxyalkyl-substituted ethylenediamines, trimethylenediamines, tetramethylenediamines, tetramethylenetriamines, pentamethylenediamines and hexamethylenediamines, in which the alkyl or hydroxyalkyl substituent may be $C_1$–$C_6$ alkyl or hydroxyalkyl; and hexamethylenetetramine.

Hexamethylenetetramine is also known as methenamine, 1,3,5,7-tetraazatricyclo(3.3.1.1$^{3,7}$)-decane, or HMT, and has the structure:

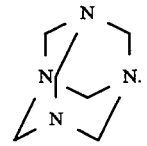

Ammonia and ammonium hydroxide will react with CME and BCME, and can be incorporated with the alkali-metal hydroxide and surfactant of the present invention for decontamination of CME and BCME, but they are not considered appropriate for use in the present invention because of their volatility and odor. They also tend to be less effective than the preferred basic organic amines in reducing BCME vapors over a spill.

Because the amine regenerates in the presence of the base, its content in the decontaminating solution need not be closely related to the amount of CME or BCME on the contaminated surface. The amount of amine in the solution must be sufficient to react quickly with the CME or BCME, thus limiting the concentration of the CME or BCME vapor in air over the spill. One way to specify the concentration of amine in the solution is in terms of equivalents of amine nitrogen per 100 grams of solution. The number of equivalents may readily be determined by first determining the equivalent weight of the amine, based on the amine nitrogens in the molecule, by dividing the molecular weight of the amine by the number of amine nitrogens in the amine. The number of equivalents per 100 grams of solution is then determined by dividing the number of grants of amine in the solution by the equivalent weight of the amine. Thus for HMT, which has a molecular weight of 140.2 and four amine nitrogens, the equivalent weight is 140.2/4=35.05, and a solution containing 5% HMT contains 5/35.05=0.143 equivalents per 100 grams. A preferred range of amine in the decontaminating solution is from about 0.005 to about 0.50 equivalents per 100 grams, a more preferred range is from about 0.05 to about 0.3, and a still more preferred range is from about 0.07 to about 0.20 equivalents per 100 grants. The preferred range of HMT in the decontaminating solution is from about 1 to about 20 grams per 100 grams of solution, more preferably from about 3 to about 10 grams per 100 grams of solution.

The alkali-metal hydroxide neutralizes any acids that might be present on the contaminated surfaces, and which would consume part of the available amine, thus reducing the effectiveness of the decontamination agent. The alkali-metal hydroxide also maintains a basic pH at the contaminated surface, which promotes the reaction between the amine and any CME or BCME which may be present. Preferred are potassium, sodium and lithium hydroxides, and particularly preferred is sodium hydroxide. The alkali-metal hydroxide is preferably present at front about 1% to about 20% by weight of the decontaminating solution, and more preferably from about 2% to about 10% by weight of the decontaminating solution. The total number of moles of alkali-metal hydroxide present is also from about 0.5 to about 1.5 times the number of moles of potential acid in the spilled CME solution, preferably front about 0.8 to about 1.2 times the number of moles of potential acid in the spilled CME solution. The number of moles of potential acid is basically the number of moles of chloride ion which would be produced in the above reactions, but is affected by any free acid or base present in the spilled solution or on the contaminated surface.

The surfactant acts as a wetting agent, produces a foam which serves to inhibit evaporation of CME and BCME, helps to keeps the decontamination agent in contact with the contaminated surface, to increase its opportunity to react with the CME and BCME, and helps the decontamination agent to penetrate the pores of a porous, contaminated surface. Any nonionic surfactant which produces foam is operable in the present invention, and preferred are those nonionic surfactants which produce large amounts of foam. Anionic surfactants are generally unsuitable because they would tend to precipitate in the presence of the quaternary amines which will be found in the decontaminating solution after contact with the CME spill, and cationics are generally unsuitable because they tend to foam poorly in the presence of the high concentration of ions expected in the decontamination environment. The nonionic surfactant is preferably present at from about 1% to about 10% by weight of the decontaminating solution, preferably from about 3% to about 8% by weight of the decontaminating solution.

The following examples are intended to illustrate the invention and not to limit it except as it is limited in the claims. All ratios and percentages herein are by weight unless otherwise specified, and all reagents indicated in the examples are of good commercial quality unless otherwise specified.

EXAMPLE 1

This example is intended to illustrate the surface-decontamination method of the present invention using hexamethylenetetramine (HMT) as the organic amine, an ethylene oxide adduct of octylphenol containing an average of 40 ethylene oxide units per octylphenol unit for the nonionic surfactant, and sodium hydroxide for the alkali-metal hydroxide.

The equipment used for this example was intended to provide safe containment of BCME and CME vapors, and to simulate a contaminated surface from which the free liquid of a CME spill has been drained, but which is still wet with a film of the liquid containing CME, BCME or both. The equipment consisted of a Pyrex® glass cylinder with dimensions 20.3 cm inside diameter (ID)×35.6 cm long and having eight threaded glass connectors for 9.5-mm outside-diameter (OD) tubing, an acrylic tray about 34×10 cm, and a 9.8-cm-diameter, glass Petri dish lid. Four of the eight threaded glass connectors were sealed with poly(tetrafluoroethylene) plugs, and the others were connected to an air inlet line, an air outlet line, a temperature-measuring device and an inlet line for the spill simulant and decontaminant. The air inlet line was connected to an air-flow meter and flow control, and the air outlet line was connected to a silica gel column of 2.5-cm ID and 61-cm length, containing a 20-cm bed of partially dry silica gel, a 5-cm bed of indicating Drierite® calcium sulfate, and a second 20-cm bed of silica gel in which the CME and BCME were decomposed prior to venting the exiting air. The silica gel column exited through a water scrubber into a hood.

The solution of CME and BCME used to simulate a spill was prepared by charging to a reactor vessel 73.3 g methyl formcel, 13.6 g methanol and 1.7 g water, and cooling the charge to 20° C. To this was added 174.8 g chlorosulfonic acid gradually over a period of two hours, followed by 45 g water added over a period of 15 minutes, adjusting the addition rate to keep the temperature of the vessel contents in the range of 20°–35° C. The vessel contents were then cooled to 25° C., and 18.23 g of an aqueous 40% (weight/volume) solution of $FeC_{13}$ was added over 30 minutes, maintaining the temperature below about 30° C.

The decontamination solution was prepared by adding 50 g sodium hydroxide to 750 ml deionized water, stirring to dissolve, adding 50 g hexamethylenetetramine (HMT) to the solution and stirring to dissolve, adding 50 g of the ethylene oxide adduct of octylphenol containing an average of 40 ethylene oxide units per octylphenol unit (Triton® X-405 nonionic surfactant), and adding deionized water to make 1.0 liter of solution. This solution contained 5% by weight of HMT.

Air was passed through the apparatus at a rate of 1.24 liters/minute. Five ml of CME-BCME solution was injected through the inlet port into the Petri dish lid using a 5ml syringe. An initial 100-microliter (μl) sample of outlet air was taken for gas chromatographic determination of its CME-BCME content, and the decontamination solution was added through the inlet port into the Petri dish lid. Samples were taken four times per hour until the level of CME-BCME fell below the limit of detectability. The gas chromatographic analysis using an electron-capture detector gave a detectability limit for CME of 20 parts per billion (ppb), and for BCME of 8 ppb. The results of this example are shown in Table I, below.

EXAMPLES 2 AND 3

This example is intended to illustrate the surface-decontamination method of the present invention using another amine.

The procedure of Example I was repeated, using 100 g and 200g, respectively, of tetrakis (2-hydroxyethyl) ethylenediamine (THED) to prepare separate decontamination solutions containing 10% (Example 2) and 20% (Example 3), respectively. by weight of THED. These weights were equivalent to somewhat less and somewhat more, respectively, than the amine in the HMT of Example 1. The results of these examples are shown in Table I, below.

EXAMPLE 4

This comparative example is intended to illustrate surface decontamination using a solution containing ammonia.

The procedure of Example 1 was repeated, using ammonium hydroxide to produce a concentration of 0.3%, by weight, $NH_3$. This weight of ammonia was roughly equivalent to the amine of the 20% THED and somewhat more than that of the HMT. The results of this example are shown in Table I, below.

TABLE I

| | Decomposition of BCME with Time | | | |
|---|---|---|---|---|
| Example: Time, Minutes | 1-5% HMT BCME, ppb | 2-10% THED BCME, ppb | 3-20% THED BCME, ppb | 4-0.3% $NH_3$ BCME, ppb |
| 0 | 624.7 | 938.2 | 272.2 | 96.1 |
| 15 | 253.2 | 1203.5 | 1990 | |
| 30 | 66.8 | 376.6 | 829.5 | 2269.3 |
| 45 | 15.2 | 140.0 | 137.5 | |
| 60 | 3.7 | 26.7 | 81.3 | 225.1 |
| 75 | 4.1 | 17.1 | 46.3 | |
| 90 | 8.2 | 9.7 | 45.4 | 46.6 |
| 105 | 0.0 | 6.9 | 18.5 | |
| 120 | 5.5 | 5.0 | 9.8 | 36.8 |
| 135 | 0.0 | 5.1 | 52.0 | |
| 150 | | 0.0 | 44.7 | 24.5 |
| 180 | | | 11.9 | 20.1 |
| 210 | | | 39.6 | 5.4 |
| 240 | | | 26.7 | 10.0 |

What is claimed is:

1. A method for decomposing chloromethyl ethers which comprises contacting a surface contaminated with chloromethylmethyl ether, bis-chloromethyl ether, or mixtures thereof, with an alkaline, aqueous solution containing A: one or more basic tertiary alkyl polyamines in which the alkyl groups are independently selected from $C_1$–$C_6$ alkyl, and which are selected from the group consisting of N-alkyl-substituted ethylenediamines, N-alkyl-substituted trimethylene-methylenediamines, N-alkyl-substituted hexamethylenediamines, N-hydroxyalkyl-substituted ethylenediamines, N-hydroxyalkyl-substituted trimethylenediamines, N-hydroxyalkyl-substituted tetramethylenediamines, N-hydroxyalkyl-substituted pentamethylenediamines and N-hydroxyalkyl-substituted hexamethylenediamines, in which the alkyl and hydroxyalkyl substituents are $C_1$–$C_6$ alkyl $C_1$–$C_6$ hydroxyalkyl; and hexamethylenetetramine, B: one or more alkali metal hydroxides and C: one or more nonionic surfactants.

2. The method of claim 1 wherein the amines are selected from the group consisting of hexamethylenetetramine, tetrakis-(2-hydroxyethyl) ethylenediamine and tetrakis (2-hydroxypropyl) ethylenediamine.

3. The method of claim 2 wherein the amine is hexamethylenetetramine.

4. The method of claim 3 wherein the hexamethylenetetramine is present at from about 1% to about 20% by weight of the aqueous solution.

5. The method of claim 3 wherein the hexamethylenetetramine is present at from about 3% to about 10% by weight of the aqueous solution.

6. The method of claim 1 wherein the alkali-metal hydroxides are sodium hydroxide, potassium hydroxide or mixtures thereof.

7. The method of claim 6 wherein the alkali-metal hydroxide is sodium hydroxide.

8. The method of claim 6 wherein the alkali-metal hydroxide is present at from about 1% to about 20% by weight of the aqueous solution.

9. The method of claim 6 wherein the alkali-metal hydroxide is present at from about 2% to about 10% by weight of the aqueous solution.

10. The method of claim 7 wherein the amines are present at from about 0.005 to about 0.5 equivalents of amine nitrogen per 100 grams of aqueous solution.

11. The method of claim 7 wherein the amines are present at from about 0.05 to about 0.3 equivalents of amine nitrogen per 100 grams of aqueous solution.

12. The method of claim 7 wherein the amines are present at from about 0.07 to about 0.2 equivalents of amine nitrogen per 100 grams of aqueous solution.

13. The method of claim 7 wherein the surfactant is present at from about 1% to about 10% by weight of the aqueous solution.

14. The method of claim 7 wherein the surfactant is present at from about 3% to about 8% by weight of the aqueous solution.

15. A method for decomposing chloromethyl ethers which comprises contacting a surface contaminated with chloromethyhnethyl ether, bis-chloromethyl ether, or mixtures thereof, with an alkaline, aqueous solution containing from about 1 to about 10% by weight of hexamethylenetetramine, from about 2% to about 10% by weight of sodium hydroxide and from about 3 to about 10% of a nonionic surfactant.

* * * * *